US011237513B2

(12) United States Patent
Macias Guzman et al.

(10) Patent No.: US 11,237,513 B2
(45) Date of Patent: Feb. 1, 2022

(54) CLEANING ELECTROPHOTOGRAPHIC PRINTING DRUMS

(71) Applicant: Hewlett-Packard Development Company, L.P., Spring, TX (US)

(72) Inventors: Minedys Macias Guzman, San Diego, CA (US); Ihab Khahil, Nes Ziona (IL); Nir Ptashnik, Nes Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/049,826

(22) PCT Filed: Jul. 27, 2018

(86) PCT No.: PCT/US2018/044027
§ 371 (c)(1),
(2) Date: Oct. 22, 2020

(87) PCT Pub. No.: WO2020/023053
PCT Pub. Date: Jan. 30, 2020

(65) Prior Publication Data
US 2021/0048773 A1 Feb. 18, 2021

(51) Int. Cl.
*G03G 21/00* (2006.01)

(52) U.S. Cl.
CPC . *G03G 21/0088* (2013.01); *G03G 2221/0005* (2013.01)

(58) Field of Classification Search
CPC ..... G03G 21/0088; G03G 21/0058; G03G 2215/0658
See application file for complete search history.

(56) References Cited

U.S. PATENT DOCUMENTS

| | | | | |
|---|---|---|---|---|
| 3,807,853 | A | 4/1974 | Hudson | |
| 4,240,760 | A | 12/1980 | Levin | |
| 4,286,039 | A | 8/1981 | Landa et al. | |
| 5,716,700 | A | 2/1998 | Kikukawa et al. | |
| 6,453,134 | B1 | 9/2002 | Ziegelmuller et al. | |
| 6,640,073 | B2 * | 10/2003 | Kurotori | G03G 15/11 399/237 |
| 6,668,150 | B2 | 12/2003 | Toyoda et al. | |
| 7,796,913 | B2 | 9/2010 | Berg et al. | |
| 7,801,461 | B2 | 9/2010 | Hoshio et al. | |
| 8,224,210 | B2 | 7/2012 | Levintant et al. | |

(Continued)

FOREIGN PATENT DOCUMENTS

| | | | |
|---|---|---|---|
| DE | 10201483 A1 * | 7/2003 | G03G 21/0058 |
| EP | 1653297 | 5/2006 | |

(Continued)

OTHER PUBLICATIONS

International Search Report dated Apr. 11, 2019 for PCT/US2018/044027, Applicant Hewlett-Packard Development Company, L.P.

*Primary Examiner* — Clayton E. LaBalle
*Assistant Examiner* — Leon W Rhodes, Jr.
(74) *Attorney, Agent, or Firm* — Thorpe North & Western LLP

(57) ABSTRACT

There is provided a sponge cleaning roller for cleaning an electrophotographic printing drum, the sponge of the cleaning roller having a Shore 00 hardness of about 9 or greater and a porosity of about 38 ppi or greater.

15 Claims, 3 Drawing Sheets

(56) References Cited

U.S. PATENT DOCUMENTS

| | | | | |
|---|---|---|---|---|
| 8,275,302 | B2 | 9/2012 | Sako et al. | |
| 8,583,021 | B2 * | 11/2013 | Kadis | G03G 15/11 399/343 |
| 9,785,083 | B2 * | 10/2017 | Morishita | G03G 15/0258 |
| 10,645,815 | B2 * | 5/2020 | Landa | H01L 31/206 |
| 2002/0076241 | A1 | 6/2002 | Kumar et al. | |
| 2005/0201785 | A1 | 9/2005 | Gila et al. | |
| 2007/0154240 | A1 * | 7/2007 | Elbert | G03G 15/0808 399/176 |
| 2008/0280125 | A1 * | 11/2008 | Denton | C23C 18/40 428/318.4 |

FOREIGN PATENT DOCUMENTS

| | | |
|---|---|---|
| JP | h05333676 | 12/1993 |
| WO | 2016018307 | 2/2016 |
| WO | 2017178043 | 10/2017 |

* cited by examiner

CLEANING ELECTROPHOTOGRAPHIC PRINTING DRUMS

BACKGROUND

Electrostatic printing processes may involve creating an image on a photoconductive surface, applying an ink having charged particles to the photoconductive surface, such that they selectively bind to the image, and then transferring the charged particles in the form of the image to a print substrate.

The photoconductive surface can be on a cylinder and is often termed a photo imaging plate (PIP). The photoconductive surface can be selectively charged with a latent electrostatic image having image and background areas with different potentials. For example, an electrostatic ink composition comprising charged toner particles in a carrier liquid can be brought into contact with the selectively charged photoconductive surface. The charged toner particles adhere to the image areas of the latent image while the background areas remain clean. The image is then transferred to a print substrate (e.g. paper) directly or, more commonly, by being first transferred to an intermediate transfer member, which can be a soft swelling blanket, and then to the print substrate. Variations of this method utilize different ways for forming the electrostatic latent image on a photoreceptor or on a dielectric material.

DETAILED DESCRIPTION

Figure 1:
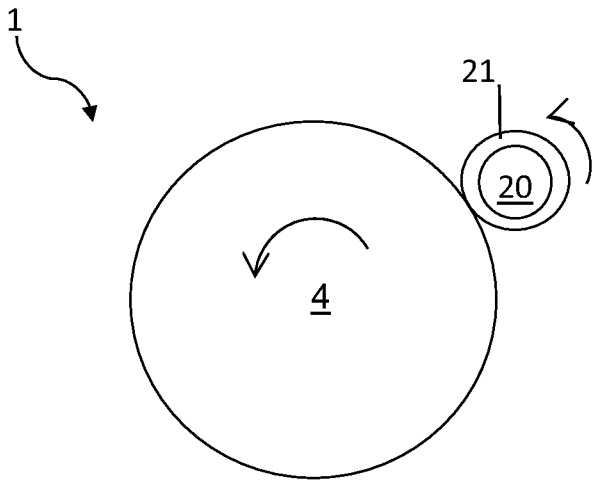
FIG. 1 shows a schematic cross-sectional view of an example of an electrophotographic printing apparatus.

Before the apparatus, methods and related aspects of the disclosure are disclosed and described, it is to be understood that this disclosure is not restricted to the particular apparatus, process features and materials disclosed herein because such apparatus and process features and materials may vary somewhat. It is also to be understood that the terminology used herein is used for the purpose of describing particular examples. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid", "carrier," or "carrier vehicle" refers to the fluid in which the polymer resin, pigment, charge directors and/or other additives can be dispersed to form a liquid electrostatic ink or electrophotographic ink. Liquid carriers can include a mixture of a variety of different agents, such as surfactants, co-solvents, viscosity modifiers, and/or other possible ingredients. The carrier liquid may be a non-polar carrier liquid such as a hydrocarbon carrier liquid, for example, aliphatic hydrocarbons, isoparaffinic compounds, paraffinic compounds, dearomatized hydrocarbon compounds.

As used herein, "electrostatic ink composition" generally refers to an ink composition, which may be in liquid form, generally suitable for use in an electrostatic printing process, sometimes termed an electrophotographic printing process. The electrostatic ink composition may include chargeable particles of the resin and the pigment dispersed in a liquid carrier, which may be as described herein.

The "electrostatic ink compositions", "liquid electrostatic inks" or "liquid electrophotographic (LEP) inks" referred to herein may comprise a colourant and a thermoplastic resin dispersed in a carrier liquid. In some examples, the thermoplastic resin may comprise an ethylene acrylic acid resin, an ethylene methacrylic acid resin or combinations thereof. In some examples, the electrostatic ink also comprises a charge director and/or a charge adjuvant. In some examples, the liquid electrostatic inks described herein may be ElectroInk® and any other Liquid Electro Photographic (LEP) inks developed by Hewlett-Packard Company, If a standard test is mentioned herein, unless otherwise stated, the version of the test to be referred to is the most recent at the time of filing this patent application.

As used herein, "electrostatic(ally) printing" or "electrophotographic(ally) printing" generally refers to the process that provides an image that is transferred from a photo imaging substrate or plate either directly or indirectly via an intermediate transfer member to a print substrate, e.g. a paper substrate. As such, the image is not substantially absorbed into the photo imaging substrate or plate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrophotographic ink composition to an electric field, e.g. an electric field having a field strength of 1000 V/cm or more, in some examples 1000 V/mm or more.

As used herein, the term "electrophotographic printing apparatus" is used to refer to a printing apparatus that may be used to carry out electrophotographic printing, for example, liquid electrophotographic printing.

As used herein, the term "about" is used to provide flexibility to a numerical range endpoint by providing that a given value may be a little above or a little below the endpoint. The degree of flexibility of this term can be dictated by the particular variable.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not just the numerical values explicitly recited as the end points of the range, but also to include all the individual numerical values or sub-ranges encompassed within that range as if each numerical value and sub-range is explicitly recited. As an illustration, a numerical range of "about 9 to about 40" should be interpreted to include not just the explicitly recited values of about 9 to about 40, but also include individual values and subranges within the indicated range. Thus, included in this numerical range are individual values such as 10, 10.5, and 11 and sub-ranges such as from 9-20, from 10-25, and from 10-30, etc. This same principle applies to ranges reciting a single numerical value. Furthermore, such an interpretation should apply regardless of the breadth of the range or the characteristics being described.

Unless otherwise stated, any feature described herein can be combined with any aspect or any other feature described herein.

Described herein is an electrophotographic printing apparatus comprising an electrophotographic printing drum and a sponge cleaning roller, the sponge of the cleaning roller contactable with the electrophotographic printing drum and having a Shore 00 hardness of about 9 or greater and a porosity of about 38 ppi or greater.

Also described herein is a method of cleaning an electrophotographic printing drum, the method comprising contacting a sponge of a sponge cleaning roller with an electrophotographic printing drum, the sponge of the cleaning roller having a Shore 00 hardness of about 9 or greater and a porosity of about 38 ppi or greater.

Also described herein is a sponge cleaning roller for cleaning an electrophotographic printing drum, the sponge of the cleaning roller having a Shore 00 hardness of about 9 or greater and a porosity of about 38 ppi or greater.

In some electrophotographic printing processes components of a liquid electrostatic ink composition may be deposited on an electrophotographic printing drum and may remain on the printing drum after transfer of a developed image to a print substrate. In some examples, a cleaning fluid is used to clean an electrophotographic printing drum, at least some of the cleaning fluid may remain on the surface of the electrophotographic printing drum. In some examples, the cleaning fluid is selected from the same liquids as the carrier liquid described herein, for example the cleaning fluid may be the same as the carrier liquid. In some examples, the cleaning fluid is non-polar, e.g. a hydrocarbon cleaning fluid. The cleaning fluid and/or components of a liquid electrostatic ink composition remaining on an electrophotographic printing drum may be exposed to plasma during the charging process, for example during the formation of a latent electrophotographic image on an electrophotographic printing drum. Exposure of the cleaning fluid and/or components of a liquid electrostatic ink composition on an electrophotographic printing drum to plasma may lead to the oxidation of the cleaning fluid along with any other contaminants (e.g. components of the liquid electrostatic ink composition remaining on an electrophotographic printing drum after transfer of a developed image to a print substrate) upon the surface of the electrophotographic printing drum to form a material which may be referred to as "honey". "Honey" formed on the electrophotographic printing drum may be chemically attached to the surface of the electrophotographic printing drum and can cause severe print quality problems. The strong chemical adhesion between "honey" and the electrophotographic printing surface makes this substance difficult to remove. Previous solutions to addressing this print quality problem have required stopping printing (i.e. taking the printing apparatus offline") relatively frequently, for example either to replace the electrophotographic printing drum or for etching/lapping of the printing drum. The present inventors have found that by employing a sponge cleaning roller as described herein, the number of print cycles which may be completed before it is necessary to take the printing apparatus offline is considerably increased.

Electrophotographic Printing Apparatus

Described herein is an electrophotographic printing apparatus comprising an electrophotographic printing drum and a sponge cleaning roller.

Electrophotographic Printing Drum

An electrophotographic printing drum may be any drum suitable for use in an electrophotographic printing process, e.g. a liquid electrophotographic printing process.

In some examples, the electrophotographic printing drum may be a traditional photo imaging plate (PIP) comprising a metal layer (e.g. aluminium layer) disposed on a substrate (e.g. mylar substrate). A traditional PIP may comprise a charge generating layer disposed on the metal layer and a charge transfer layer disposed on the charge generating layer. In some examples, the charge generating layer and/or the charge transfer layer comprise a binder resin, for example a thermoplastic or thermosetting resin such as polymethylmethacrylate, polystyrene, vinyl polymers such as polyvinyl chloride, polycarbonates, polyesters, polysulfones, phenoxy resins, epoxy resins, silicone resins. In some examples, the charge generating layer and/or the charge transfer layer comprise a polycarbonate binder resin. In some examples, the drum is cylindrical, and charge transfer layer, for example charge transfer layer comprising a binder resin (such as a polycarbonate binder resin) may be disposed on an outer curved surface of the drum that connects two circular ends of the drum. In some examples, the charge transfer layer is disposed on the curved surface along part of, or all of, the length of the drum, the length of the drum being along the axis of the drum. In some examples, the charge transfer layer is disposed on the curved surface all or part way circumferentially around the drum. In some examples, the charge generating layer and a metal layer are disposed below the charge transfer layer and extend over the substrate of the drum to the same extent as the charge transfer layer.

In some examples, the electrophotographic printing drum may be an imaging drum comprising an amorphous silicon photoconductor surface. Amorphous silicon is a non-crystalline allotrope of silicon. In some examples, the imaging drum comprises an electrically conductive substrate having a layer of amorphous silicon thereon, which, during printing, may act as an image receiving layer. The electrically conductive substrate may comprise or be a metal, e.g. chrome or aluminium, or electrically conductive compound, e.g. indium tin oxide. In some examples, the electrically conductive substrate may be disposed on an insulating layer. The insulating layer may comprise an electrically insulating material, which may be selected from glass, alumina or quartz. In some examples, the drum is cylindrical, and amorphous silicon may be disposed on an outer curved surface of the drum that connects two circular ends of the drum. In some examples, amorphous silicon is disposed on the curved surface along part of, or all of, the length of the drum, the length of the drum being along the axis of the drum. In some examples, amorphous silicon is disposed on the curved surface all or part way circumferentially around the drum.

Sponge Cleaning Roller

The sponge cleaning roller comprises sponge having a Shore 00 hardness of about 9 or greater and a porosity of about 38 ppi or greater.

The sponge may be any suitable material for use with a cleaning fluid, for example for use with a hydrocarbon cleaning fluid. As used herein, the term "sponge" refers to a material comprising interconnected pores ("pores" may also be referred to herein as "cells"), for example, such that a cleaning fluid can be absorbed into and/or pass through the sponge material. A "pore" (or "cell") is a cavity in a material, the cavity at least partially bounded by walls of the material. In a material comprising interconnected pores such as the sponge described herein, at least some of the walls bounding some of the pores do not fully enclose the pores (i.e. at least some of the walls bounding some of the pores do not fluidly isolate the pores) such that fluid can pass between pores.

In some examples, the sponge may be formed of a polymer foam. A polymer foam is a polymeric material comprising pores (or cells). Pores in a polymer foam may be generated by gaseous displacement during polymerization to form the polymeric material comprising pores. The pores in a polymer foam are at least partially bounded by walls of the polymeric material. In order for the sponge formed of a polymer foam to comprise interconnected pores, at least some of the polymer walls bounding some of the pores do not fluidly isolate the pores, i.e. such that fluid can pass between the pores (i.e. the polymer foam is an open-cell foam). In some examples, the sponge may be formed from a reticulated polymer foam. A "reticulated polymer foam" is highly porous foam due to the breaking down of the cells by (for example by forcing a pressurised gas through the cells of the polymer foam) such that the polymer foam comprises no closed cells (closed pores), i.e. all pores within a reticulated foam are fluidly connected. In some examples, the sponge of the sponge cleaning roller is polymer foam, e.g. an open cell polymer foam. For example, the polymer foam may be a polyurethane foam, a polyester foam a polypropylene foam, a polyethylene foam, a polyurethane silicone foam, or a polyether polyurethane foam. In some examples, the sponge of the cleaning roller is an open cell polyurethane foam.

"Shore 00 hardness" is a durometer scale used to determine the hardness of a material. The scale contains values from 0 to 100 with higher values indicating a harder material. A durometer measures the depth of an indentation in a material created by a given force on a standardized presser foot, the force and presser foot used being particular to the durometer scale being used (as specified in ASTM D2240). The Shore 00 hardness of a material, e.g. the sponge of the sponge cleaning roller, may be determined according to ASTM D2240. For example, the Shore 00 hardness of the sponge may be determined using an automated durometer such as a Zwick 3105 Combi test, or a manual durometer such as a durometer stand and a Shore 00 gauge from PTC Instrument.

The porosity of the sponge of the cleaning roller may be defined in terms of the number of pores in one linear inch (ppi) and may be determined under visual inspection with a microscope (for example, a microscope such as Leica DM LM from McBain Instruments with 5 to 20× magnification). In order to determine the number of pores in one linear inch the number of pores (each pore being at least partially bounded by a wall) along a one inch long line on the surface of the sponge of the sponge roller is counted. As the sponge comprises interconnected pores, pores situated below surface level pores may be visible. Therefore, the pores in one linear inch is determined as the number of pores having at least a part of a pore wall level with the surface of the sponge of the sponge roller along the one inch line on the surface of the sponge of the sponge roller.

In some examples, the sponge has a porosity of about 38 ppi or greater, for example about 40 ppi or greater, about 45 ppi or greater, about 50 ppi or greater, about 52 ppi or greater, about 55 ppi or greater, about 60 ppi or greater, or about 65 or greater.

In some examples, the sponge has a porosity of up to about 90 ppi, for example up to about 87 ppi up to about 80 ppi, up to about 70 ppi, or up to about 60 ppi.

In some examples, the sponge has a porosity of about 38 to about 87 ppi, for example about 65 to about 85 ppi, about 67 to about 87 ppi, or about 45 to about 60 ppi.

In some examples, the sponge of the cleaning roller has a Shore 00 hardness of about 9 or greater, for example about 10 or greater, about 12 or greater, about 15 or greater, about 18 of greater, or about 20 or greater.

In some examples, the sponge of the cleaning roller has a Shore 00 hardness of up to about 40, for example up to about 35, up to about 32, up to about 30, up to about 27, or up to about 25.

In some examples, the sponge of the cleaning roller has a Shore 00 hardness in the range of about 9 to about 40, for example about 20 to about 32, or about 18 to about 25.

In some examples, the sponge of the cleaning roller has a Shore 00 hardness in the range of about 9 to about 40 and a porosity of about 38 to about 87 ppi.

In some examples, the sponge of the cleaning roller has a Shore 00 hardness in the range of about 12 to about 40 and a porosity of about 45 to about 87 ppi.

In some examples, the sponge of the cleaning roller has a Shore 00 hardness in the range of about 12 to about 40 and a porosity of about 50 to about 87 ppi.

In some examples, the sponge of the cleaning roller has a Shore 00 hardness in the range of about 15 to about 40 and a porosity of about 50 to about 87 ppi.

In some examples, the sponge of the cleaning roller has a Shore 00 hardness in the range of about 18 to about 40 and a porosity of about 50 to about 87 ppi.

In some examples, the sponge of the cleaning roller has a Shore 00 hardness in the range of about 18 to about 40 and a porosity of about 52 to about 87 ppi.

In some examples, the sponge of the cleaning roller has a Shore 00 hardness in the range of about 20 to about 32 and a porosity of about 65 to about 85 ppi.

In some examples, the sponge of the cleaning roller has a Shore 00 hardness in the range of about 18 to about 25 and a porosity of about 45 to about 60 ppi.

In some examples the tensile strength of the sponge of the cleaning roller is at least about 190 kPa.

FIG. 1 shows a schematic illustration of an electrophotographic printing apparatus 1 comprising an electrophotographic printing drum 4 and a sponge cleaning roller 20, the sponge of the cleaning roller 20 being contactable with the electrophotographic printing drum 4 and having a Shore 00 hardness of about 9 or greater and a porosity of about 38 ppi or greater. The sponge cleaning roller 20 comprises at least an outer layer 21 of sponge. In some examples, the sponge cleaning roller may comprises an inner core, for example a metal inner core.

In some examples, the sponge cleaning roller 20 is moveable from a cleaning position in which the sponge of the sponge cleaning roller engages with the surface of the printing drum 4 and a disengaged position in which the sponge cleaning roller 20 does not contact the printing drum 4. In some examples, the sponge cleaning roller 20 is automatically moved to the cleaning position during printing and automatically moved to the disengaged position when printing stops.

In some examples, in the cleaning position the sponge cleaning roller is positioned such that the axis of rotation of the sponge cleaning roller is at least about 1 mm towards the axis of rotation of the printing drum past the point of first contact between the sponge cleaning roller and the printing drum, in some examples at least about 2 mm, in some examples at least about 3 mm, and in some examples at least about 3.5 mm.

In some examples, the sponge cleaning roller is motorised, for example motorised to have a constant rolling speed with respect to the surface of the printing drum during cleaning.

Figure 2:
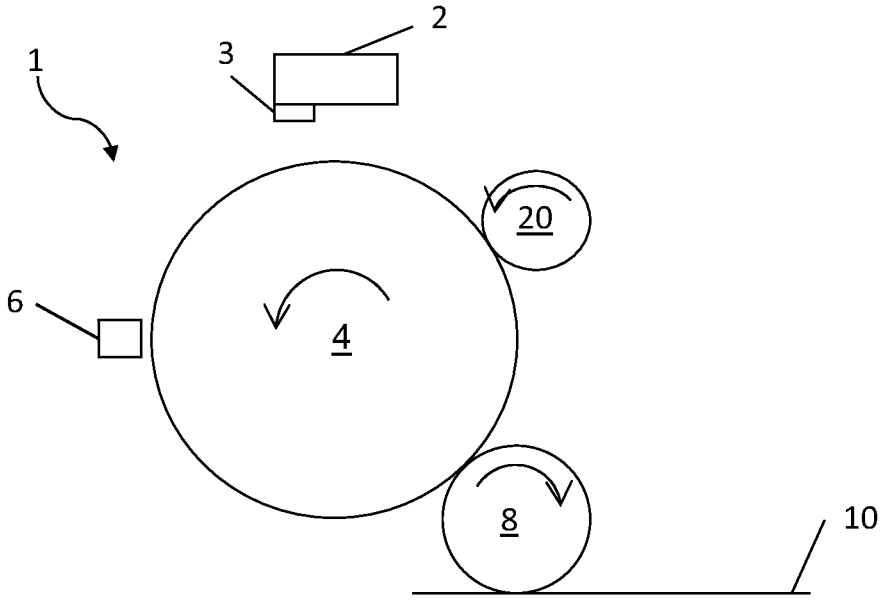
FIG. 2 shows a schematic cross-sectional view of an example of an electrophotographic printing apparatus.

FIG. 2 also shows a schematic illustration of an electrophotographic printing apparatus 1 comprising an electrophotographic printing drum 4 and a sponge cleaning roller 20. Printing of an image using a liquid electrophotographic ink composition and cleaning of the printing drum 4 will now be described in relation to the printing apparatus 1 shown in FIG. 2.

An image, including any combination of graphics, text and images, may be communicated to the printing apparatus 1. In order to print an electrophotographic ink composition, firstly, the photo charging unit 2 deposits a uniform static charge on the electrophotographic printing drum 4 and then a laser imaging portion 3 of the photo charging unit 2 dissipates the static charges in selected portions of the image area on the electrophotographic printing drum 4 (in this examples the electrophotographic printing drum is an imaging drum comprising an amorphous silicon photoconductor surface) to leave a latent electrostatic image. The latent electrostatic image is an electrostatic charge pattern representing the image to be printed. The electrophotographic ink composition is then transferred to the electrophotographic printing drum 4 by Binary Ink Developer (BID) unit 6. The BID unit 6 present a uniform film of the electrophotographic ink composition to the electrophotographic printing drum 4. A resin component of the electrophotographic ink composition may be electrically charged by virtue of an appropriate potential applied to the electrophotographic ink composition in the BID unit. The charged resin component which, by virtue of an appropriate potential on the electrostatic image areas, is attracted to the latent electrostatic image on the electrophotographic printing drum 4 (first transfer). The electrophotographic ink composition does not adhere to the uncharged, non-image areas and forms an image on the surface of the latent electrostatic image. The electrophotographic printing drum 4 then has a developed electrophotographic ink composition image on its surface.

The image may then transferred from the electrophotographic printing drum 4 to an intermediate transfer member (ITM) 8 by virtue of an appropriate potential applied between the electrophotographic printing drum 4 and the ITM 8, such that the charged electrophotographic ink composition is attracted to the ITM 8 (second transfer). The image may then be dried and fused on the ITM 8 before being transferred to a print substrate 10.

The printing apparatus 1 also includes a sponge cleaning roller 20, the sponge of the cleaning roller being contactable with the electrophotographic printing drum 4 and having a Shore 00 hardness of about 9 or greater and a porosity of about 38 ppi or greater.

The sponge cleaning roller 20 may be contacted with the printing drum 4 to clean the surface of the printing drum 4. In some examples, during printing (e.g. the printing process described above), the sponge cleaning roller 20 is moved into the cleaning position to clean the surface of the printing drum 4. In some examples, when printing stops, the sponge cleaning roller 20 is moved to the disengaged position such that the cleaning roller 20 does not contact the printing drum 4.

Figure 3:
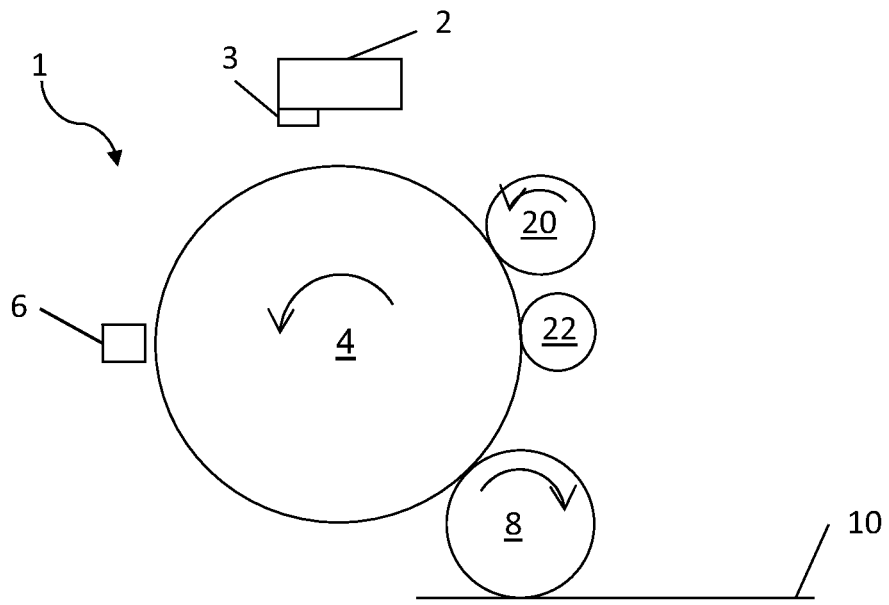
FIG. 3 shows a schematic cross-sectional view of an example of an electrophotographic printing apparatus.

FIG. 3 also shows a schematic illustration of an electrophotographic printing apparatus 1 comprising an electrophotographic printing drum 4 and a sponge cleaning roller 20. Features described using like reference numerals in FIGS. 1 and 2 also apply to the apparatus shown in FIG. 3.

Printing apparatus 1 shown in FIG. 3 comprises a cleaning fluid dispensing roller 22 in addition to the sponge cleaning roller 20. The cleaning fluid dispensing roller 22 supplies cleaning fluid to the surface of the electrophotographic printing drum before the surface to which the cleaning fluid has been applied reaches the sponge cleaning roller 20. In some examples, cleaning fluid may be supplied directly to the cleaning roller 20. In some examples, the cleaning fluid dispensing roller 22 supplies a constant flow of cleaning fluid to the surface of the electrophotographic printing drum 4 when the cleaning roller 20 is in the cleaning position. When the sponge cleaning roller is in the cleaning position described above, the cleaning fluid dispensing roller 22 may also contact the surface of the electrophotographic drum 4 to supply cleaning fluid to the printing drum 4 before the surface is cleaned with sponge cleaning roller 20. In some examples, the cleaning fluid dispensing roller 22 contacts the printing drum 4 when the cleaning roller 20 is in the cleaning position. In some examples, the cleaning fluid dispensing roller 22 may be spaced from the printing drum 4 when the cleaning roller 20 is in the disengaged position. In some examples, the cleaning fluid dispensing roller 22 is moveable with the cleaning roller 20. The cleaning fluid dispensing roller 22 may be formed of any material suitable for applying cleaning fluid to the surface of the electrophotographic printing drum 4. For example, the cleaning fluid dispensing roller 22 may comprise a sponge formed from the same materials suitable for the sponge cleaning roller 20. In some examples, the cleaning fluid dispensing roller 22 may be formed from a rubber material, for example the cleaning fluid dispensing roller 22 may be a rubber gravure roller. In some examples, cleaning fluid is supplied to the surface of a printing drum 4 at a rate in the range of about 4 l/min to about 15 l/min, for example the cleaning fluid dispensing roller 22 may supply cleaning fluid to the printing drum surface at a rate of about 4 l/min to about 15 l/min.

Figure 4:
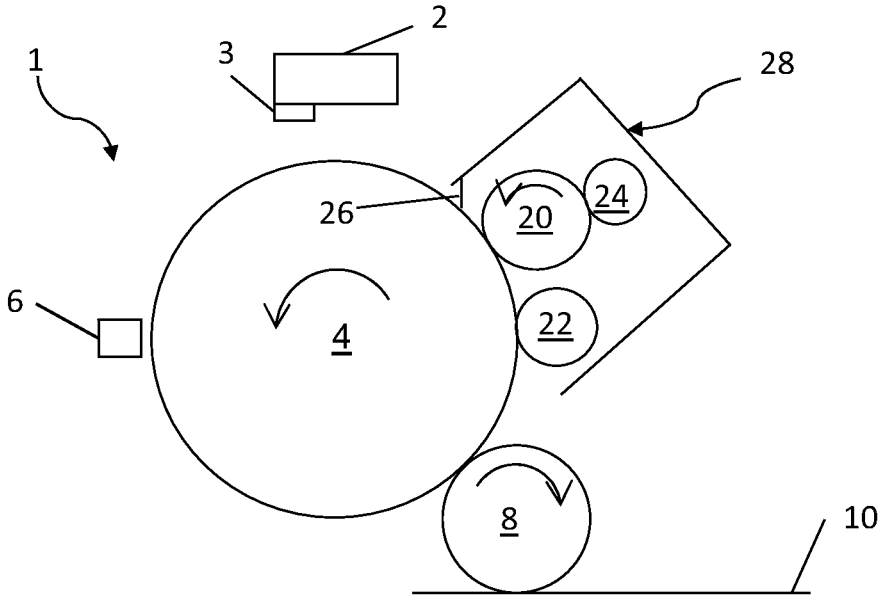
FIG. 4 shows a schematic cross-sectional view of an example of an electrophotographic printing apparatus.

FIG. 4 also shows a schematic illustration of an electrophotographic printing apparatus 1 comprising an electrophotographic printing drum 4 and a sponge cleaning roller 20. Features described using like reference numerals in FIGS. 1 to 3 also apply to the apparatus shown in FIG. 4.

Printing apparatus 1 shown in FIG. 4 comprising a cleaning station 28 comprising the sponge cleaning roller 20 along with a squeegee roller 24, cleaning fluid dispensing roller 22 and resilient blade 26. The resilient blade 26 is also contactable with the printing drum 4. In some examples, the resilient blade 26 contacts the printing drum 4 when the cleaning roller 20 is in the cleaning position. In some examples, the resilient blade 26 may be spaced from the printing drum 4 when the cleaning roller 20 is in the disengaged position. In some examples, the resilient blade 26 is moveable with the cleaning roller 20. The resilient blade may be formed of a material such as a polymer, for example polyurethane. The resilient blade 26 may be employed to remove dirty cleaning fluid from the surface of the printing drum 4. The squeegee roller 24 may be contactable with the cleaning roller 20, for example to remove cleaning fluid and dirt from the cleaning roller 20. The squeegee roller 24 may be formed of a material harder than the sponge of the cleaning roller 20, for example the squeegee roller 24 may be formed of a metal material.

EXAMPLES

The following illustrates examples of the aspects described herein. Thus, these examples should not be considered to restrict the present disclosure, but are merely in place to teach how to make examples of apparatus and methods of the present disclosure.

Comparative Example 1

A sponge cleaning roller was provided comprising polyurethane sponge (i.e. an open cell polyurethane foam) having a Shore 00 hardness of 5 (determined according to ASTM D2240) and a porosity of 51 ppi. This sponge cleaning roller represents a conventional cleaning roller for use in a LEP printing apparatus.

Example 1

A sponge cleaning roller was provided comprising a polyurethane sponge (i.e. an open cell polyurethane foam) having a Shore 00 hardness of 30 (determined according to ASTM D2240) and a porosity of 84 ppi.

Examples 2-4

The sponge cleaning rollers of examples 2-4 were providing as for Example 1 except that the sponge of the sponge cleaning roller was formed of a polymer foam as detailed in Table 1 below having a Shore 00 hardness and porosity as set out in Table 1 below.

TABLE 1

| Example | Sponge | Porosity (ppi) | Shore 00 hardness |
|---|---|---|---|
| C. Ex. 1 | open cell polyurethane foam | 51 | 5 |
| 1 | open cell polyurethane foam | 84 | 30 |
| 2 | open cell polyurethane foam | 40 | 10 |
| 3 | reticulated polyurethane foam | 54 | 20 |
| 4 | open cell polyurethane foam | 57 | 15 |

Testing

The cleaning performance of the cleaning rollers of Comparative Example 1 and Examples 1-4 were compared by inserting the cleaning rollers into a liquid electrophotographic printing apparatus as described in FIG. 3 and the electrophotographic printing drum employed was a PIP comprising an aluminium layer and polycarbonate charge transfer and generation layers. The printing apparatus was operated to continuing printing an image until severe print quality defects were shown on the prints (dark lines showing dirt build up on the printing drum ("honey") and bright lines indicating scratching to the printing drum).

After 50 k impressions the printing drum being cleaned by the cleaning roller of Comparative Example 1 was deemed to show severe print quality defects, whereas the printing drums being cleaned by the cleaning rollers of Examples 1-4 did now show the same severity of print quality defects after 120K impressions, in some instances up to 200K impressions.

SEM micrographs of the printing drum cleaned with the cleaning roller of Example 1 showed that the printing drum was etched by about 1 micron over 1M impressions, indicating that the use of a harder sponge (e.g. the sponge of Example 1) gradually erodes the surface of the PIP allowing the surface of the PIP to be constantly refreshed during a printing operation.

The sponge cleaning rollers of Examples 1-4 were compared for cleaning efficiency during the testing described above. Table 2 below provides qualitative results of the cleaning efficiency and dripping performance of each of the cleaning rollers of Examples 1-5. A grading score from 1-5 is provided for cleaning performance and dripping, with a score of 1 indicating poor performance and a score of 5 indicating best performance.

TABLE 2

| Example | Porosity (ppi) | Shore 00 hardness | Cleaning efficiency | Dripping |
|---|---|---|---|---|
| C. Ex. 1 | 51 | 5 | 3 | 5 |
| 1 | 84 | 30 | 5 | 5 |
| 2 | 40 | 10 | 5 | 2 |
| 3 | 54 | 20 | 5 | 5 |
| 4 | 57 | 15 | 4 | 4 |

The inventors have found that improvements in cleaning are observed for cleaning rollers with a Shore 00 hardness of about 9 or greater and a porosity of about 38 ppi or greater.

The present inventors have found that the combination of porosity and hardness of the sponge of the cleaning roller described herein provides a cleaning roller exhibiting much improved cleaning compared to existing cleaning rollers.

The present inventors have found that providing a cleaning roller comprising a sponge formed of an open cell polymeric foam allows for lubrication of the surface of the printing drum which reduces detrimental effects of friction on the surface of the printing drum and provides for the collection and release of dirt removed from the surface of the printing drum.

The present inventors have also found that providing a sponge having a porosity as defined herein allows for a cleaning fluid to flow through the sponge of the cleaning roller with minimal restriction without excessive dripping of cleaning fluid onto the printing drum, and also efficient removal of "honey" from the surface of the printing drum as indicated by the cleaning efficiency results provided in Table 2 above.

The cleaning rollers tested have been found to mechanically scrape "honey" and gradually erode the surface of the printing drum without damaging its printing abilities. Importantly, the sponge cleaning roller described herein allows the surface of the printing drum to be cleaned sufficiently online so that print quality is maintained without the need to stop printing as frequently as previous solutions.

The inventors have found that using a sponge roller comprising a sponge with the combination of hardness and porosity described herein allows for excellent cleaning by mechanical scraping of "honey" from the printing drum surface and also ensuring dirt and cleaning fluid is removed efficiently and does not drip from the cleaning roller so that the formation of "honey" on the printing drum surface is also reduced.

While the printing apparatus, methods and related aspects have been described with reference to certain examples, it will be appreciated that various modifications, changes, omissions, and substitutions can be made without departing from the spirit of the disclosure. It is intended, therefore, that the printing apparatus, methods and related aspects be limited only by the scope of the following claims. Unless otherwise stated, the features of any dependent claim can be combined with the features of any of the other dependent claims, and any other independent claim.

The invention claimed is:

1. An electrophotographic printing apparatus comprising:

an electrophotographic printing drum; and a sponge cleaning roller, the sponge of the sponge cleaning roller contactable with the electrophotographic printing drum during printing and having a Shore 00 hardness of about 9 to about 100 and a porosity of about 38 ppi to about 90 ppi.

2. The electrophotographic printing apparatus according to claim 1, wherein the electrophotographic printing drum is an imaging drum comprising an amorphous silicon photoconductor surface and the sponge of the sponge cleaning roller is contactable with the amorphous silicon photoconductor surface of the imaging drum.

3. The electrophotographic printing apparatus according to claim 1, wherein the electrophotographic printing drum is a photo-imaging plate and the sponge of the sponge cleaning roller is contactable with an outer surface of the photo-imaging plate.

4. The electrophotographic printing apparatus according to claim 1, wherein the sponge cleaning roller is moveable from a cleaning position in which the sponge of the sponge cleaning roller engages with the surface of the electrophotographic printing drum and a disengaged position in which the sponge cleaning roller does not contact the electrophotographic printing drum.

5. The electrophotographic printing apparatus according to claim 1, wherein the sponge cleaning roller automatically contacts the electrophotographic printing drum to clean the electrophotographic printing drum during printing.

6. The electrophotographic printing apparatus according to claim 1, wherein the sponge of the sponge cleaning roller has a Shore 00 hardness in the range of about 9 to about 40.

7. The electrophotographic printing apparatus according to claim 1, wherein the sponge of the sponge cleaning roller has a porosity of about 38 ppi to about 87 ppi.

8. The electrophotographic printing apparatus according to claim 1, wherein the sponge of the sponge cleaning roller has a Shore 00 hardness in the range of about 12 to about 40 and a porosity of about 45 to about 87 ppi.

9. The electrophotographic printing apparatus according to claim 1, wherein the sponge of the sponge cleaning roller includes a reticulated polymer foam.

10. A method of cleaning an electrophotographic printing drum, the method comprising contacting a sponge of a sponge cleaning roller with an electrophotographic printing drum during printing, the sponge of the cleaning roller having a Shore 00 hardness of about 9 to about 100 and a porosity of about 38 ppi to about 90 ppi.

11. The method according to claim 10, wherein the sponge of the cleaning roller has a Shore 00 hardness in the range of about 9 to about 40 and a porosity of about 38 ppi to about 87 ppi.

12. A sponge cleaning roller for cleaning an electrophotographic printing drum, the sponge of the sponge cleaning roller including a reticulated polymer foam and having a Shore 00 hardness of about 9 to about 100 and a porosity of about 38 ppi to about 90 ppi.

13. The sponge cleaning roller according to claim 12, wherein the sponge of the sponge cleaning roller has a Shore 00 hardness in the range of about 9 to about 40 and a porosity of about 38 ppi to about 87 ppi.

14. The sponge cleaning roller according to claim 12, wherein the sponge the sponge cleaning roller has a Shore 00 hardness in the range of about 12 to about 40 and a porosity of about 45 ppi to about 87 ppi.

15. The sponge cleaning roller according to claim 12, rein the reticulated polymer foam is a polyurethane foam.

* * * * *